US011927021B2

(12) United States Patent
Delestre

(10) Patent No.: US 11,927,021 B2
(45) Date of Patent: Mar. 12, 2024

(54) TAPE APPLICATOR WITH TAPE PROTECTION AND METHOD FOR MAINTAINING SUCH AN APPLICATOR

(71) Applicant: ÉTABLISSEMENTS PIERRE GRÉHAL ET CIE SA, Baillet en France (FR)

(72) Inventor: Lionel Delestre, Beaumont-sur-Oise (FR)

(73) Assignee: ÉTABLISSEMENTS PIERRE GRÉHAL ET CIE SA, Baillet en France (FR)

( * ) Notice: Subject to any disclaimer, the term of this patent is extended or adjusted under 35 U.S.C. 154(b) by 302 days.

(21) Appl. No.: 17/608,500

(22) PCT Filed: May 29, 2019

(86) PCT No.: PCT/FR2019/000088
§ 371 (c)(1),
(2) Date: Nov. 3, 2021

(87) PCT Pub. No.: WO2020/240100
PCT Pub. Date: Dec. 3, 2020

(65) Prior Publication Data

US 2022/0228375 A1 Jul. 21, 2022

(51) Int. Cl.
*E04F 21/02* (2006.01)
*E04F 21/165* (2006.01)

(52) U.S. Cl.
CPC ..... *E04F 21/026* (2013.01); *E04F 21/1655* (2013.01); *E04F 21/1657* (2013.01)

(58) Field of Classification Search
CPC .. E04F 21/026; E04F 21/1655; E04F 21/1657
See application file for complete search history.

(56) References Cited

U.S. PATENT DOCUMENTS

| | | | | |
|---|---|---|---|---|
| 2,328,571 | A | 9/1943 | Meyer | |
| 4,196,028 | A | 4/1980 | Mills et al. | |
| 2003/0066611 | A1* | 4/2003 | Gunn | E04F 21/1657 156/577 |
| 2009/0094936 | A1* | 4/2009 | Brown | E04F 21/165 52/749.1 |

* cited by examiner

*Primary Examiner* — Daniel McNally
(74) *Attorney, Agent, or Firm* — Clark & Brody LP

(57) ABSTRACT

An applicator of jointing tape for joining two sheets of plasterboard includes a mud chamber through which the tape is paid out. The chamber has a tape inlet slot formed between a free end of a rear wall of the chamber and a first free end of a lower wall of the chamber. The free end of the rear wall of the chamber and the first free end of the lower wall of the chamber comprise a cylinder with a cross section greater than a thickness of the wall to which each cylinder is attached, each cylinder being covered by a removable protective sleeve with an interior cross section that complements the cylinder that the sleeve covers, each protective sleeve having a longitudinal opening delimited by two immobilization edges for immobilization against the wall bearing the cylinder that the sleeve covers.

5 Claims, 3 Drawing Sheets

[Fig. 1]
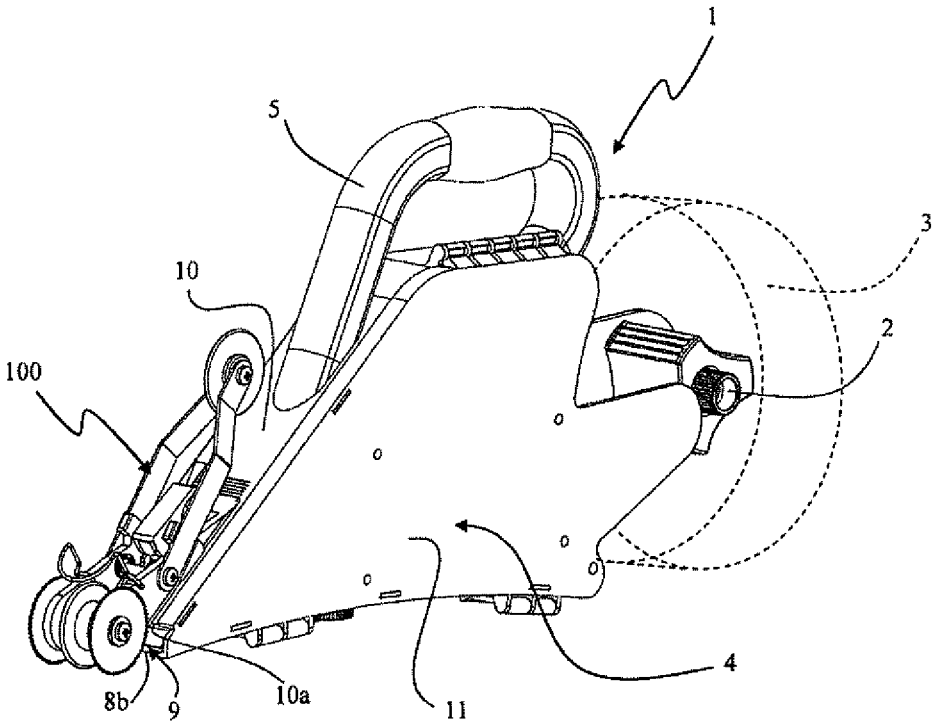
[Fig. 2]
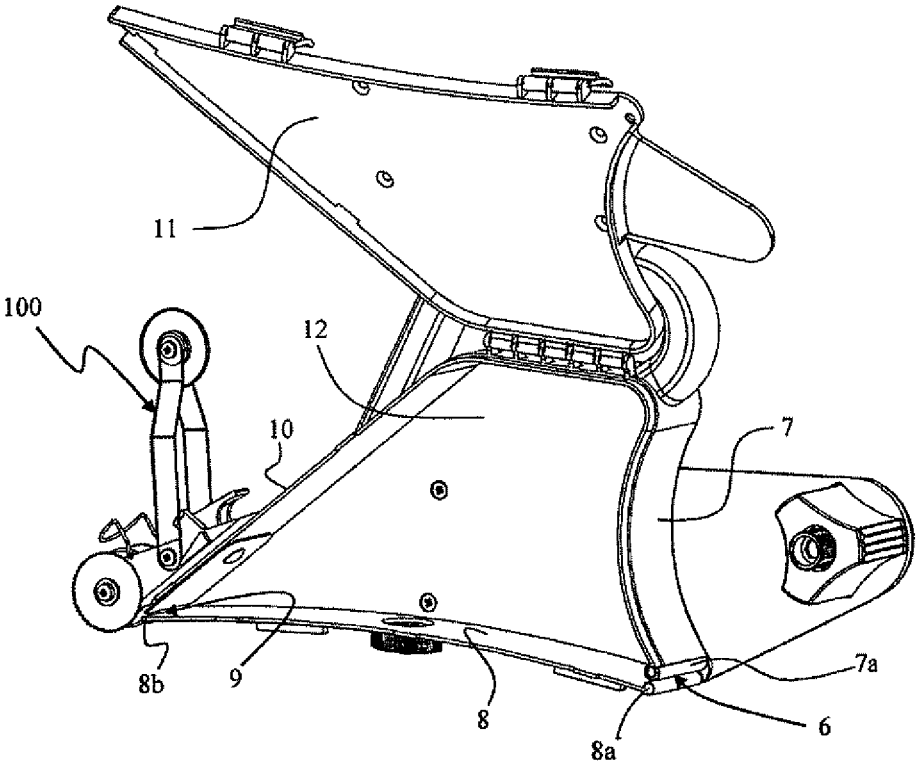

[Fig. 3]
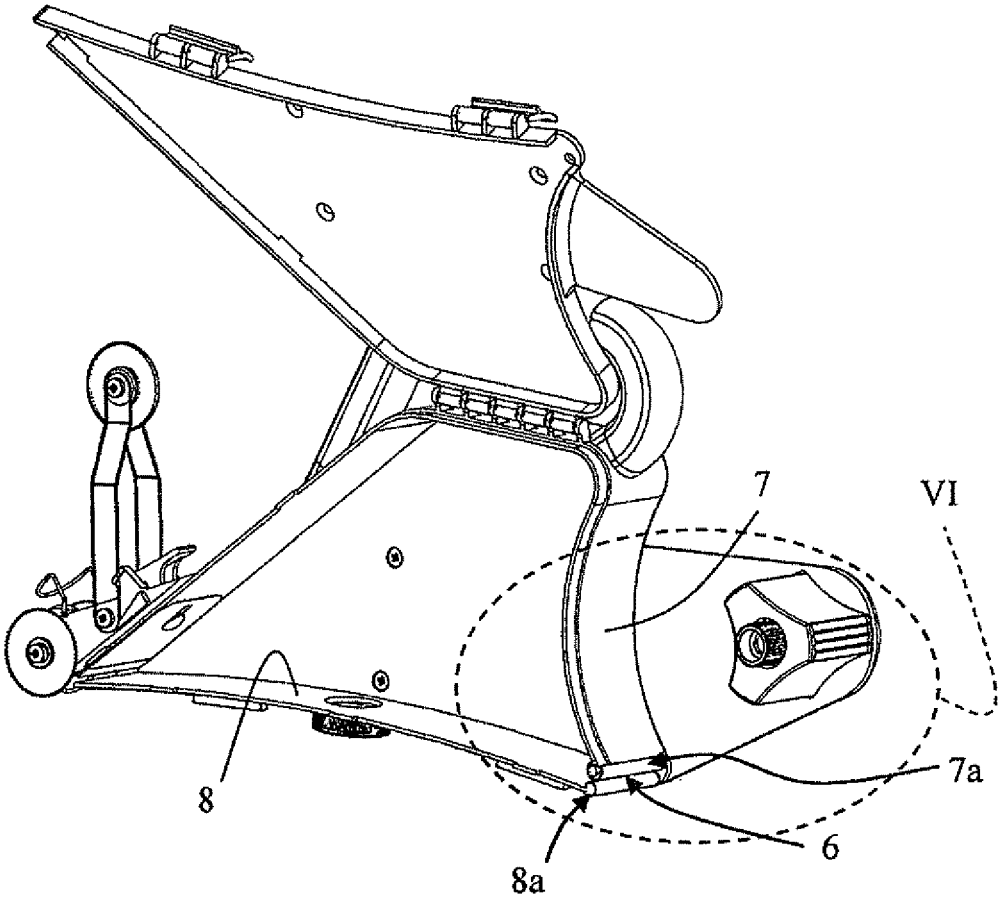
[Fig. 4]
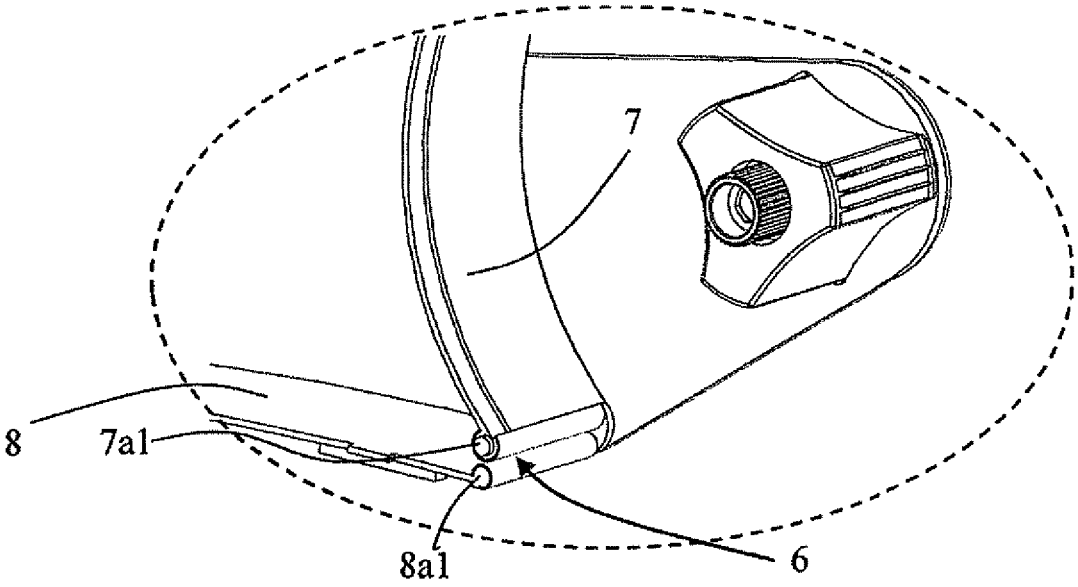

[Fig. 5]
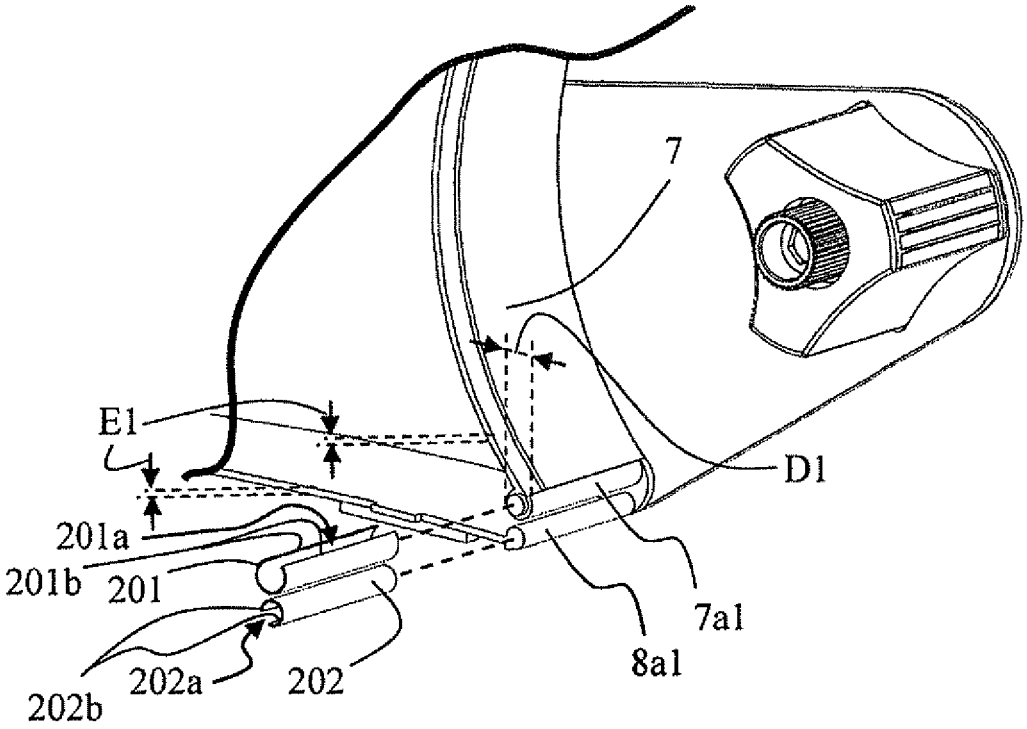

TAPE APPLICATOR WITH TAPE PROTECTION AND METHOD FOR MAINTAINING SUCH AN APPLICATOR

The present invention relates to a tape applicator with tape protection and to a method for maintaining such an applicator.

Such an applicator is intended for laying a tape made of paper or similar material, in the form of a roll, between two adjacent sheets of plasterboard, during building or renovation work, using a pasty jointing compound known as mud.

Thus, the mud fills the space between the two sheets and the tape holds them together.

The tape is laid along two sheets positioned in one and the same plane or at a corner-forming angle. Once the mud and the tape are in position, the user smooths them using a flat spatula, or a corner spatula for the corners. The tape thus makes it possible to obtain a perfectly smooth join between the sheets.

Tape applicators, commonly known as taping "banjos" are already known and illustrated, for example in the document U.S. Pat. No. 2,328,571. They comprise a mud chamber in which the tape is loaded with mud during application. The also comprise a payout device for paying out a jointing tape from a roll in order to carry out numerous jointing operations, in particular on large jobs.

To this end, the chamber has, with reference to the use position, a tape inlet slot formed between a free end of a rear wall of the chamber and a first free end of a lower wall of the chamber, and a tape outlet slot formed between a free end of a frontal wall of the chamber and a second free end of the lower wall of the chamber.

To fill the chamber, that latter also has two side walls, one of which constitutes a removable side cover for accessing the inside of the chamber. The cover may be removed by being withdrawn or by being pivoted.

To fill applicators of the taping banjo type, the cover is opened, the tape is positioned manually against the rear, upper and frontal walls, then the space formed between the tape positioned in this way and the lower surface of the chamber is filled with mud.

An application head is generally intended to be attached to the frontal wall of the chamber, above the outlet slot, to ensure correct application of the tape, namely to extract the mud-laden tape from the applicator and press the tape onto the sheets of plasterboard. The user then performs a finishing smoothing operation using a spatula.

During the application of the tape, the latter is subjected to high stresses: by the application head, which generally comprises at least one drive wheel which pulls on the tape and presses it onto the sheets of plasterboard, by friction against the mud, and by friction against the tape inlet slot.

The phenomenon of abrasion during the application of the tape is known and occurs most often at the outlet slot, which is subjected to significant friction by the mud-laden tape. Moreover, this friction generates a significant increase in temperature, which increases the erosion of the outlet slot, the chamber generally being made of plastic.

The phenomenon of abrasion also occurs at the inlet slot, which constitutes a point of inflection in the tape, between the payout device and the outlet slot, in particular when the chamber is full and the tape is pressed against the upper wall of the chamber.

Thus, in the event of excessive traction, for example when the application movement is fast, the tape heats up significantly at the inlet of the chamber, it frequently breaks, making it necessary to open the chamber and replace the tape. This operation is particularly time-consuming and dirty when the chamber is full.

Therefore, an objective of the present invention is to propose an applicator of simple design that is easy to maintain, allowing rapid application of the tape, while limiting the risks of the tape breaking at the inlet slot.

Besides the economic advantage of rapid laying of the tape, this rapid laying may also have a technical advantage if the mud used is particularly fluid.

Specifically, some users use mud that is more liquid than the muds sold ready for use, for practical, economic or technical reasons.

However, liquid mud is associated with a significant risk of leaking through the inlet slot, even though the movement of the tape tends to drive the mud toward the outlet slot.

The present invention also aims to propose a multifunctional applicator, that is to say one that can be adapted to the use of muds with different viscosities, while limiting the risk of the tape breaking while it is being laid.

It is therefore an objective of the present invention to propose a tape applicator provided with adjusting means that are easy to operate and robust, fairly insensitive to abrasion and heat, and inexpensive, i.e. easily replaceable without tools.

According to the invention, the geometry of the slot is modified and designed to receive self-securing protective sleeves, the thickness of which is chosen to adapt the height of the slot to the viscosity of the mud employed.

Thus, one subject of the invention is an applicator of jointing tape for joining two sheets of plasterboard, the applicator comprising a payout device for paying out a jointing tape from a roll and a mud chamber through which the tape is paid out in use, the chamber having, with reference to the use position, a tape inlet slot formed between a free end of a rear wall of the chamber and a first free end of a lower wall of the chamber, and a tape outlet slot formed between a free end of a frontal wall of the chamber and a second free end of the lower wall of the chamber, the latter also comprising two side walls, one of which constitutes a removable side cover for accessing the inside of the chamber. According to the invention, the free end of the rear wall of the chamber and the first free end of the lower wall of the chamber comprise a cylinder with a cross section greater than a thickness of the wall to which each cylinder is attached, and in that each cylinder is covered by a removable protective sleeve with a cross section that complements the cylinder that the sleeve covers, each protective sleeve having a longitudinal opening delimited by two immobilization edges for immobilization against the wall bearing the cylinder that the sleeve covers.

According to particular embodiments:

- each cylinder may have a circular cross section, each protective sleeve having an open C-shaped circular cross section; and/or
- the protective sleeves may have a thickness such that when they are inserted around the cylinders of the free end of the rear wall and of the lower wall, they are spaced apart by an inlet slot height that is such that, in use, the tape is able to pass through freely but the mud stored in the chamber is not.

A further subject of the invention is a kit for applying jointing tape for joining two sheets of plasterboard, the kit comprising an applicator as above and a plurality of protective sleeves of different thicknesses to allow the height of the inlet slot to be adjusted depending on the viscosity of the mud that is to be used.

A further subject of the invention is a method for maintaining a jointing tape applicator as above, the method comprising the following steps:

a) opening the lateral wall constituting the removable side cover in order to access the inside of the chamber and the free ends of the rear wall and of the lower wall;

b) removing the protective sleeves from the free ends of the rear wall and of the lower wall of the chamber by sliding them along the cylinders borne by said free ends of the rear wall and of the lower wall of the chamber;

c) inserting new protective sleeves by sliding them along the cylinders borne by the free ends of the rear wall and of the lower wall of the chamber; d) closing the side wall constituting the removable side cover again.

Further features of the invention will be stated in the following detailed description, given with reference to the appended drawings, in which, respectively:

FIG. 1 shows a schematic perspective view of a tape applicator according to the invention in the use position, namely in the position for applying a tape;

FIG. 2 shows a schematic perspective view of the tape applicator in FIG. 1, with the cover for accessing the inside of the chamber open;

FIG. 3 shows a schematic perspective view of an applicator according to the invention, comprising a system for protecting the tape inlet slot;

FIG. 4 shows a schematic perspective view of an enlargement of FIG. 3, centered on the tape inlet slot, which comprises protective sleeves affording protection against abrasion; and FIG. 5 shows a schematic exploded perspective view of FIG. 4, illustrating the particular structure of the protective sleeves according to the invention.

An applicator provided with means for protecting the tape at the outlet slot according to the invention is illustrated in FIGS. 1 and 2.

The applicator 1 comprises a payout device 2 for paying out a jointing tape from a roll 3 (illustrated in dotted line) and a mud chamber 4 through which the tape is paid out in use.

The applicator also comprises a holding handle 5 for transporting it or handling it operationally during application of the tape.

Alternatively or in combination, the applicator may comprise a carry strap (not illustrated) allowing the applicator to be picked up from beneath.

As illustrated in FIG. 2, the chamber 4 has, with reference to the use position, a tape inlet slot 6 formed between a free end 7*a* of a rear wall 7 of the chamber and a first free end 8*a* of a lower wall 8 of the chamber.

The chamber 4 also comprises a tape outlet slot 9 formed between a free end 10*a* of a frontal wall 10 of the chamber and a second free end 8*b* of the lower wall 8 of the chamber.

The chamber further comprises two side walls 11 and 12, one of which constitutes a removable side cover 11 for accessing the inside of the chamber 4.

The applicator may have an application head 100 having particular functionalities, for example for applying the tape in a corner.

As illustrated in FIGS. 3 to 5, the invention provides means that allow effective and inexpensive protection of the tape inlet slot against abrasion and increases in temperature, specifically in a way that offers great ease of maintenance.

Moreover, these means make it possible to reduce leaks of mud at the inlet slot 6 of the tape 3, depending on the viscosity of the mud. They thus allow better control of the flow rate of mud at the outlet slot 9.

Thus, the free end 7*a* of the rear wall 7 of the chamber and the first free end 8*a* of the lower wall 8 of the chamber each comprise a cylinder, 7*a*1 and 8*a*1, respectively, with a cross section D1 greater than a thickness E1 of the wall (7 and 8, respectively) to which each cylinder 7*a*1 and 8*a*1 is attached.

According to the invention, each cylinder, 7*a*1 and 8*a*1, respectively, is covered with a removable protective sleeve 201 and 202, respectively, with an interior cross section that complements the cylinder, 7*a*1 and 8*a*1, respectively, that the sleeve covers.

Each protective sleeve 201 and 202 has a longitudinal opening 201*a*-202*a*, delimited by two immobilization edges, 201*b* and 202*b*, respectively, for immobilization against the wall (7 and 8, respectively) bearing the cylinder 7*a*1 and 8*a*1, respectively, that the sleeve 201 and 202, respectively, covers.

The sleeves 201-202 are thus self-immobilizing against the wall that bears the cylinders, since the edges 201*b* and 202*b* of the longitudinal openings 201*a*-202*a* are arranged at the junction where the wall and the cylinder meet, this junction exhibiting a point of inflection preventing the sleeves from sliding or from falling off the cylinder.

These sleeves are advantageously made of metal, such as stainless steel. The material thus exhibits resistance to abrasion and to heat that is far greater than that of the plastic generally used in the manufacture of the tape applicators.

Moreover, this structure of the free ends of the rear and lower walls is very easy to produce by molding.

The sleeves, if they have become worn, are very easy to change.

The method for performing maintenance on such a type applicator comprises a first step of opening the side wall constituting the removable side cover 11 for accessing the inside of the chamber 4 and the free ends 7*a* and 8*a* of the rear wall 7 and of the lower wall 8.

The worn protective sleeve or sleeves 201-202 is or are then removed from the free ends 7*a* and 8*a* of the rear wall 7 and/or of the lower wall 8 of the chamber by sliding them along the cylinders 7*a*1-8*a*1 borne by said free ends.

New protective sleeves are then inserted, by sliding them along the cylinders 7*a*1-8*a*1 borne by the free ends of the rear wall and of the lower wall of the chamber. To do that, the longitudinal opening of each sleeve is aligned with the wall 7 or 8 bearing the cylinder onto which the sleeve is slipped. The immobilization edges 201*b* and 202*b* of the longitudinal openings 201*a*-202*a* of the sleeves are therefore positioned at the junction where the wall meets the cylinder.

Finally, the side wall 11 constituting the removable side cover is closed again.

Preferably, each cylinder 7*a*1-8*a*1 has a circular cross section and each protective sleeve 201-202 has an open C-shaped circular cross section. That ensures optimal contact with the tape while it is being applied, without sharp edges, and avoids any tearing of the tape. It is thus possible to increase the rate of application.

Besides affording protection against abrasion, this structure of the sleeves also allows the applicator to be adapted to the viscosity of the mud used.

Thus, a user wishing to employ a mud that is more fluid than normal will change the sleeves so that the tape inlet slot is not as tall, thereby limiting leaks of mud.

For this purpose, the protective sleeves 201-202 have a thickness such that when they are inserted around the cylinders of the free end of the rear wall and of the lower wall, they are spaced apart by an inlet slot height that is such that, in use, the tape is able to pass through freely but the mud stored in the chamber is not.

It is therefore possible to offer a kit for applying jointing tape for joining two sheets of plasterboard, comprising a tape applicator and a plurality of protective sleeves of different thicknesses to allow the height of the inlet slot to be adjusted depending on the viscosity of the mud that is to be used.

By virtue of the invention, an applicator is obtained that allows rapid application of the tape, without fear of the tape tearing at the inlet slot, and without fear of the inlet slot being damaged on account of abrasion and the friction temperature.

Moreover, the applicator is very multifunctional since it adapts to different mud viscosities.

The invention claimed is:

1. An applicator (1) of jointing tape for joining two sheets of plasterboard, the applicator comprising a payout device (2) for paying out a jointing tape from a roll (3) and a mud chamber (4) through which the tape is paid out in use, the chamber having, with reference to the use position, a tape inlet slot (6) formed between a free end (7*a*) of a rear wall (7) of the chamber and a first free end (8*a*) of a lower wall (8) of the chamber, and a tape outlet slot (9) formed between a free end (10*a*) of a frontal wall (10) of the chamber and a second free end (8*b*) of the lower wall (8) of the chamber, the latter also comprising two side walls (11-12), one of which constitutes a removable side cover for accessing the inside of the chamber, characterized in that the free end (7*a*) of the rear wall (7) of the chamber and the first free end (8*a*) of the lower wall (8) of the chamber comprise a cylinder (7*a*1-8*a*1) with a cross section (D1) greater than a thickness (E1) of the wall to which each cylinder is attached, and in that each cylinder is covered by a removable protective sleeve (201-202) with an interior cross section that complements the cylinder that the sleeve covers, each protective sleeve having a longitudinal opening (201*a*-202*a*) delimited by two immobilization edges (201*b*-202*b*) for immobilization against the wall bearing the cylinder that the sleeve covers.

2. The applicator (1) as claimed in claim 1, wherein each cylinder has a circular cross section, each protective sleeve having an open C-shaped circular cross section.

3. The applicator (1) as claimed in claim 1, wherein the protective sleeves have a thickness such that when they are inserted around the cylinders of the free end of the rear wall and of the lower wall, they are spaced apart by an inlet slot height that is such that, in use, the tape is able to pass through freely but the mud stored in the chamber is not.

4. A kit for applying jointing tape for joining two sheets of plasterboard, characterized in that it comprises an applicator (1) as claimed in claim 1 and a plurality of protective sleeves of different thicknesses to allow the height of the inlet slot to be adjusted depending on the viscosity of the mud that is to be used.

5. A method for maintaining a jointing tape applicator as claimed in claim 1, characterized in that it comprises the following steps:

a) opening the side wall constituting the removable side cover in order to access the inside of the chamber and the free ends of the rear wall and of the lower wall;

b) removing the protective sleeves from the free ends of the rear wall and of the lower wall of the chamber by sliding them along the cylinders borne by said free ends of the rear wall and of the lower wall of the chamber;

c) inserting new protective sleeves by sliding them along the cylinders borne by the free ends of the rear wall and of the lower wall of the chamber;

d) closing the side wall constituting the removable side cover again.

* * * * *